US006532339B1

(12) United States Patent
Edgar et al.

(10) Patent No.: US 6,532,339 B1
(45) Date of Patent: Mar. 11, 2003

(54) DEVICE FOR THERMALLY PROCESSING A GAS STREAM, AND METHOD FOR SAME

(75) Inventors: Bradley L. Edgar, San Jose, CA (US); Richard J. Martin, San Jose, CA (US); Michael P. Barkdoll, Knoxville, TN (US)

(73) Assignee: Thermatrix, Inc., San Jose, CA (US)

( * ) Notice: Subject to any disclaimer, the term of this patent is extended or adjusted under 35 U.S.C. 154(b) by 0 days.

(21) Appl. No.: 09/950,275

(22) Filed: Sep. 10, 2001

Related U.S. Application Data

(63) Continuation of application No. 09/072,851, filed on May 5, 1998, now abandoned.

(51) Int. Cl.[7] ..... H05B 3/78

(52) U.S. Cl. ..... 392/490; 392/465; 392/466; 392/491

(58) Field of Search ..... 392/490; 422/168, 422/171, 174, 176, 177, 179; 165/164, 165, 166, 167, 170, 168

(56) References Cited

U.S. PATENT DOCUMENTS

| | | | |
|---|---|---|---|
| 1,812,341 | A | 6/1931 | Jaegerlad |
| 2,236,976 | A | 4/1941 | Rosenblad |
| 2,795,054 | A | 6/1957 | Bowen, III |
| 2,976,853 | A | 3/1961 | Hunter et al. |
| 3,661,497 | A | 5/1972 | Castelluci et al. |
| 3,769,922 | A | 11/1973 | Furlong et al. |
| 3,807,090 | A | 4/1974 | Moss |
| 3,810,732 | A | 5/1974 | Koch |
| 3,888,193 | A | 6/1975 | Kishigami et al. |
| 3,900,554 | A | 8/1975 | Lyon |
| 3,921,713 | A | 11/1975 | Schnitzer et al. |
| 3,942,264 | A | 3/1976 | Zenkner |
| 4,047,876 | A | 9/1977 | Rice |
| 4,206,746 | A | 6/1980 | Chubb |

(List continued on next page.)

OTHER PUBLICATIONS

Burke, S.P. et al., "Diffusion Flames", *First Symposium (International) on Combustion*, 1954, 2–11.

"California could end heavy diesel vehicle sales", *Oil and Gas J.,* 1994, 42 and 44.

Control of Air Pollution from New Motor Vehicles and New Motor Engines, *Federal Register,* 1993, 58 (55), 15781–15802.

(List continued on next page.)

*Primary Examiner*—Teresa Walberg
*Assistant Examiner*—Thor Campbell
(74) *Attorney, Agent, or Firm*—Luedeka, Neely & Graham, P.C.

(57) ABSTRACT

A spiral shaped device for thermally processing a gas stream and a method of use thereof is provided. The spiral shaped device has at least one sidewall formed into a coil; at least one spiral passage, defined by the sidewall, for directing the gas stream through the device, and having an inlet and an outlet; and a matrix of heat resistant inert media disposed in at least a portion of the device. The device is particularly useful as a recuperative flameless thermal oxidizer for oxidizing organic material contained in the gas stream or as a heat exchanger. When the device is used as a flameless thermal oxidizer, the device preferably has at least two coiled sidewalls; at least two spiral passages defined by the coiled sidewalls; a chamber located proximate to the interior ends of the coiled sidewalls for directing the gas stream from the spiral inlet passage to spiral outlet passage; and a matrix of heat resistant inert media, preferably disposed in at least the chamber. When the device is used as a heat exchanger, the device preferably has two separate loops, where one loop directs a gas stream and the second loop directs a fluid stream in and out of the device to enable heat transfer therebetween. In the method of the present invention, a gas stream is directed in the device of the present invention, and is thermally processed therein.

37 Claims, 10 Drawing Sheets

U.S. PATENT DOCUMENTS

| | | | |
|---|---|---|---|
| 4,252,070 | A | 2/1981 | Benedick |
| 4,259,088 | A | 3/1981 | Moss |
| 4,284,401 | A | 8/1981 | Tatebayashi et al. |
| 4,355,504 | A | 10/1982 | Liu et al. |
| 4,380,149 | A | 4/1983 | Ludecke |
| 4,400,356 | A | 8/1983 | McVay et al. |
| 4,475,884 | A | 10/1984 | Shang et al. |
| 4,529,374 | A | 7/1985 | Malik et al. |
| 4,627,812 | A | 12/1986 | Kelly et al. |
| 4,643,667 | A | 2/1987 | Fleming |
| 4,646,660 | A | 3/1987 | Björkman et al. |
| 4,688,495 | A | 8/1987 | Galloway |
| 4,702,075 | A | 10/1987 | Jenny |
| 4,716,884 | A | 1/1988 | Koch |
| 4,741,690 | A | 5/1988 | Heed |
| 4,785,768 | A | 11/1988 | Brown et al. |
| 4,807,695 | A | 2/1989 | Ward |
| 4,823,711 | A | 4/1989 | Kroneberger et al. |
| 4,828,481 | A | 5/1989 | Weil et al. |
| 4,838,782 | A | 6/1989 | Wills |
| 4,870,824 | A | 10/1989 | Young et al. |
| 4,911,894 | A | 3/1990 | Retallick et al. |
| 4,941,415 | A | 7/1990 | Pope et al. |
| 4,953,512 | A | 9/1990 | Italiano |
| 4,969,328 | A | 11/1990 | Kammel |
| 4,974,530 | A | 12/1990 | Lyon |
| 5,059,575 | A | 10/1991 | Jorgensen et al. |
| 5,165,884 | A | 11/1992 | Martin et al. |
| 5,320,518 | A | 6/1994 | Stilger et al. |
| 5,326,537 | A | 7/1994 | Cleary |
| 5,426,936 | A | 6/1995 | Levendis et al. |
| 5,533,890 | A | 7/1996 | Holst et al. |
| 5,547,650 | A | 8/1996 | Edgar et al. |
| 5,567,390 | A | 10/1996 | Cleary |
| 5,601,790 | A | 2/1997 | Stilger et al. |
| 5,635,139 | A | 6/1997 | Holst et al. |
| 5,637,283 | A | 6/1997 | Stigler et al. |
| 5,650,128 | A | 7/1997 | Holst et al. |

OTHER PUBLICATIONS

"Focus on Industry Solutions for Exhaust Pollution Control", *Automotive Engineer,* 1994, pp. 18, 20, 22, 24, 26, 27, 28, 29.

Haynes, B.S. et al., "Soot Formation", *Progress in Energy and Combustion Science,* 1990, 7, 229–273.

Kahair, M.K. et al., "Design and Development of Catalytic Converters for Diesels", SAE paper 921677, 1992, 199–209.

Keeney, T.R.E., *Auto Emissions,* 1995, 5, 4 sheets.

Wagner et al., "SCR succeeds at Logan Generating Plant", *Power Engin.,,* 1997, 28–32.

Alfa–Laval, Incorporated, Alfa–Laval Spiral Heat Exchanger Brochures, 1983, 8 pages.

Weinberg, F.J., "Combustion in Heat–Recirculating Burners", *Advanced Combustion Methods,* Weinberg (ed.,), Academic Press, 1986, Chapter 3,, 183–236.

DEVICE FOR THERMALLY PROCESSING A GAS STREAM, AND METHOD FOR SAME

This application is a continuation of copending application Ser. No. 09/072,851, filed May 5, 1998, now abandoned.

FIELD OF THE INVENTION

This invention relates to a device and method for thermal processing a gas stream. More particularly, the invention relates to a spiral shaped thermal processor and a method of use thereof.

BACKGROUND OF THE INVENTION

Developing efficient and stable combustors has been an object of longstanding research and development. Flame stability is often especially problematic for lean gas mixtures. A spiral wound combustor design, which may be used to combust lean gas mixtures, has particularly high heat recuperation or heat recirculation. The spiral wound combustor essentially consists of interspaced, spiral passages that lead to a central combustion chamber. One or more spiral inlet passages, which each lead to the central combustion chamber, are interspaced with one or more spiral outlet passages. Because the inlet gas is separated from the hot products of combustion only by the passage sidewalls, heat is transferred from the hot outlet gas stream to the incoming inlet gas stream, thereby preheating the incoming gas stream according to well known heat transfer principles.

Because of its spiral design and long residence time, spiral wound combustors generally are thermally efficient and capable of burning stoichiometrically fuel-lean mixtures while exhibiting stable combustion characteristics. A double spiral wound combustor is compact and especially effective at recuperating heat. (See for example Felix J. Weinberg, *Advanced Combustion Methods*, Chapter 3, page 207 (Academic Press, 1986) for an embodiment of a double spiral wound combustor). An example of a stoichiometrically fuel-lean mixture that may be processed in a spiral wound combustor is an off-gas containing hydrocarbons produced by various industrial processes. Such off-gases are generally regarded as atmospheric pollutants.

Despite such process-related advantages, spiral-type thermal processing devices have significant shortcomings. For example, spiral wound combustors typically are difficult to manufacture and maintain compared with simple, enclosed combustion chambers. For example, providing for uniform and desired spacing of the spiral passages during forming is often difficult. Maintenance is especially difficult at innermost portions of the spiral wound combustor, which are most likely to exhibit the most severe wear and chemical attack because of the higher temperatures that often exist therein. Further, uneven temperature distribution may result in nonuniform thermal expansion of the sidewalls, endwalls that contain the sidewalls, structural supports, and auxiliary equipment. Uneven thermal expansion may create undesirable thermal stresses in combustor components, supports, and auxiliary equipment. For example, uneven thermal expansion may cause shell buckling or may promote sealing wear and failure. Furthermore, differential rates of thermal expansion during start-up and shut-down phases of operation exacerbate uneven thermal expansion problems relating to spiral wound combustors.

It is an object of the present invention to provide a spiral shaped device that enables flameless destruction of oxidizable gases (especially in lean mixtures), that produces a stable operation, and that has high heat recuperation.

It is another object of the present invention to provide a spiral shaped device that has a temperature distribution that diminishes local temperature gradients within the high temperature regions of the device so as to diminish uneven thermal expansion therein, to diminish uneven wear and chemical attack in such high temperature regions, and to diminish the formation of pollutants (such as oxides of nitrogen) associated with such high temperature regions.

It is another object of the present invention to provide seals for the device that maintain their effectiveness when the device thermally expands.

It is yet a further object of the present invention to provide a spiral shaped device having passages that are spaced apart by features on the sidewalls of the device. Such spacing features preferably also provide uniform spacing of the passages. Further, it is an object of the present invention to provide a spiral shaped device that has features for enhancing heat transfer on the sidewalls of the device.

It is yet a further object of the present invention to produce a device that provides efficient heat exchange between a gas stream and a fluid stream.

SUMMARY OF THE INVENTION

A spiral shaped device for thermally processing a gas stream and a method of use thereof is provided. The spiral shaped device is particularly useful as a recuperative flameless thermal oxidizer or as a heat exchanger. The spiral shaped device includes at least one sidewall defining a coil; at least one spiral passage defined by the sidewall and having an inlet and an outlet; an inlet assembly in flow communication with the inlet of the spiral passage; an outlet assembly in flow communication with the outlet of the spiral passage; and a matrix of heat resistant porous inert media disposed in at least a portion of the spiral passage.

In one embodiment of the present invention, the spiral shaped device includes a structure having at least two coiled sidewalls that are interspaced apart; at least two spiral passages formed between the two coiled sidewalls for passing the gas stream through the structure, where each coiled sidewall has an interior end and two longitudinal ends and at least one of the spiral passages is an inlet for the gas stream and at least another of the spiral passages is an outlet for the gas stream; means, located at the interior ends of the coiled sidewalls, for directing the gas stream in the at least one spiral inlet passage to the at least one spiral outlet passage; and a matrix of heat resistant porous inert media disposed in at least a portion of the structure.

When the device is used as a reactor, such as a flameless thermal oxidizer, the means for directing the gas stream preferably comprises a chamber, preferably located at the center of the structure and preferably containing matrix. The chamber is situated so that it is in flow communication with the spiral passage inlet and spiral passage outlet. In the case of a flameless thermal oxidizer, at least a portion of the gas stream is preferably oxidized in the chamber in a reaction wave.

When the device is used as a heat exchanger, the means for directing the gas stream is preferably at least one transition sidewall connecting the interior ends of two coiled sidewalls to form at least one loop that directs the gas stream from the spiral inlet passage to the spiral outlet passage. In a preferred embodiment, the heat exchanger contains at least four coiled sidewalls, at least four spiral passages, and at least one transition sidewall that connects the interior ends of two nonadjacent coiled sidewalls to form two loops, where the first loop directs a gas stream through the structure and the second loop directs a fluid stream through the structure.

In a preferred embodiment of the present invention the device has a plurality of dimples located on at least a portion of at least one of the coiled sidewalls . The dimples preferably protrude into at least one of the spiral passages. The dimples may also be used to space apart at least two of the coiled sidewalls and can also enhance heat transfer between the gas stream and the sidewalls.

In another preferred embodiment of the present invention, at least one coiled sidewall, and more preferably alternating coiled sidewalls, have an insulation layer. The insulation layer can be used to enhance overall heat transfer effectiveness of the device.

In yet another preferred embodiment of the present invention, the device comprises at least one seal that is in contact with at least one longitudinal end of the coiled sidewalls. Such a seal includes a compressible material that is disposed against at least one of the longitudinal ends of the coiled sidewalls. The compressible material may be rigidly fixed or biased against the coiled sidewalls. The seal has the advantage of being able to maintain tight contact with the longitudinal ends of the device while the device thermally expands.

The present invention also provides a method for thermally processing a gas stream that includes providing a device of the present invention; directing the gas stream to flow through the spiral inlet passage to the spiral outlet passage of the device; and thermally processing the gas stream in the device.

The present invention also provides a method for making a device of the present invention including providing at least two sidewalls; spirally winding the sidewalls; and forming dimples on at least a portion of a surface of at least one of the sidewalls, the dimples spacing apart the sidewalls to form at least two spiral passages therebetween.

DETAILED DESCRIPTION OF THE PREFERRED EMBODIMENTS

The present invention provides a device and method for thermally processing a gas stream. The device is spiral in shape and has one or more coiled sidewalls that are interspaced apart to form one or more spiral passages for passing a gas stream therethrough. At least a portion of the device contains a matrix of heat resistant porous inert media.

By "thermal processing," it is meant any process involving the transfer of heat to or from the gas stream. For example, heat may be transferred to or from the gas stream for oxidizing or combusting within the spiral shaped device organic chemicals that are present in the gas stream. Also for example, heat may be transferred to or from the gas stream for conducting a reaction (such as the synthesis, destruction, oxidation, or reduction of a chemical) within the spiral shaped device. The reaction may be for example exothermic or endothermic. The spiral shaped device may also be used to transfer heat between the gas stream and another fluid. In a preferred embodiment of the present invention the spiral shaped device is used as a flameless thermal oxidizer for oxidizing organic chemicals in a gas stream. Such organic compounds may be for example volatile organic compounds or organic particulate matter dispersed in the gas stream. In another preferred embodiment of the present invention the spiral shaped device is used to transfer heat between a fluid stream and a gas stream.

By "gas stream" it is meant any chemical that can be converted into a gas or dispersed in the gas, either prior to or after entering the spiral device, that is desired to be thermally processed within the spiral shaped device. For example, the gas stream may be organic material (such as any carbon containing compound), emissions or fumes containing an oxidizable or reactable compound from a chemical processing plant, fuel gas (such as methane) used to generate energy, liquid waste from a chemical reaction, or chemical agent weapons or munitions (such as nerve gas, blister, or mustard agents). In a preferred embodiment of the present invention, the gas stream contains organic material that is to be thermally oxidized, such as volatile organic compounds, organic particulate matter, or combinations thereof. The organic particulate matter is preferably sourced from the exhaust of a diesel engine.

Figure 1:
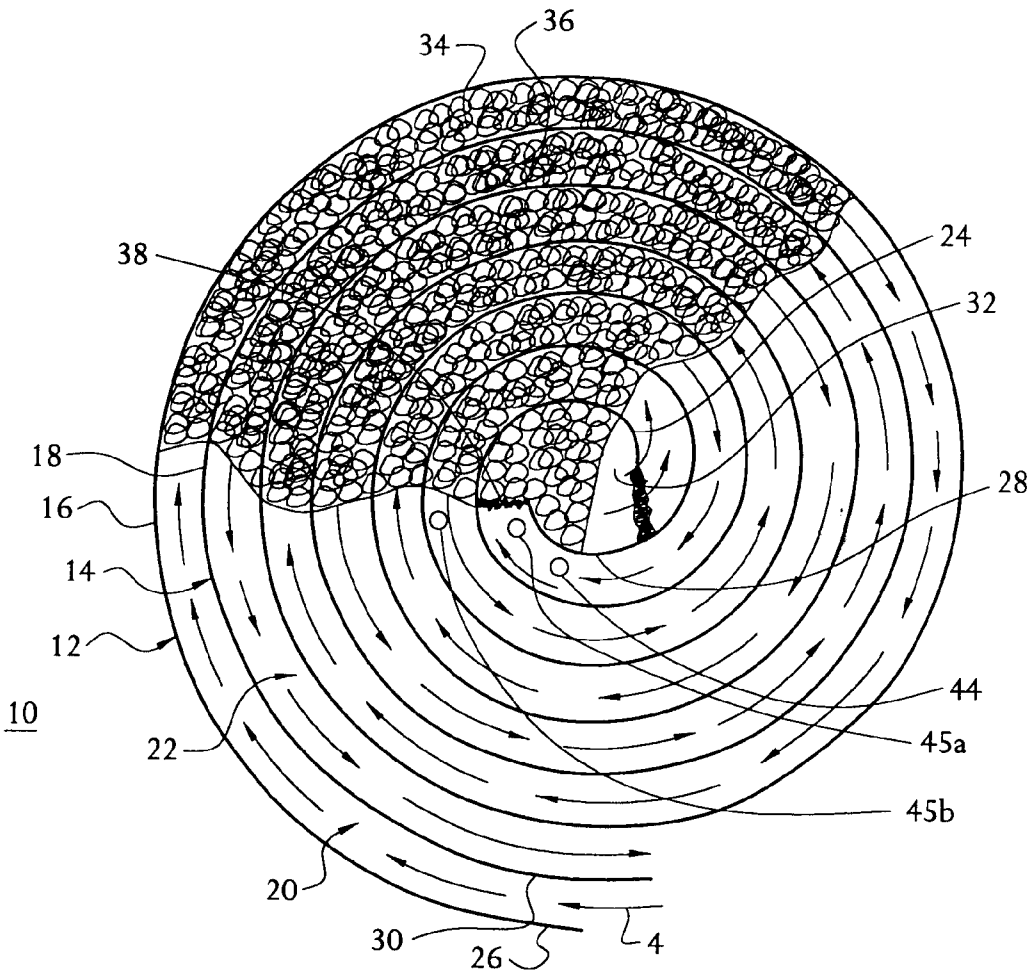
FIG. 1 is a view of the interior of the flameless thermal oxidizer according to the present invention.

Referring to the Figures where like reference numerals refer to like elements, FIG. 1 illustrates a first embodiment of the present invention. FIG. 1 is a flameless thermal oxidizer 10 that comprises a first sidewall 12 and a second sidewall 14. First sidewall 12 and second sidewall 14 each are preferably formed into coiled sidewalls 16 and 18, respectively, which are interspaced apart to form a spiral inlet passage 20 and a spiral outlet passage 22. Passages 20 and 22 direct a gas stream 4. First sidewall 12 has an interior end 24 disposed at an inner end of first coiled sidewall 16 and an exterior end 26 disposed at an outer end of first coiled sidewall 16. Second sidewall 14 has an interior end 28 disposed at an inner end of second coiled sidewall 18 and an exterior end 30 disposed at an outer end of second coiled sidewall 18. First interior end 24 is spaced apart from second interior end 28 to form chamber 32 therebetween. Chamber 32 is in flow communication with passages 20 and 22 and is a means for directing the gas stream from spiral inlet passage 20 to spiral outlet passage 22. Other means may also be used in place of, or in addition to chamber 32 for directing the gas stream from spiral inlet passage 20 to spiral outlet passage 22. Although interior ends 24 and 28 are shown curved in FIG. 1, the present invention encompasses ends 24 and 28 having other shapes (for example, tangential).

Figure 1A:
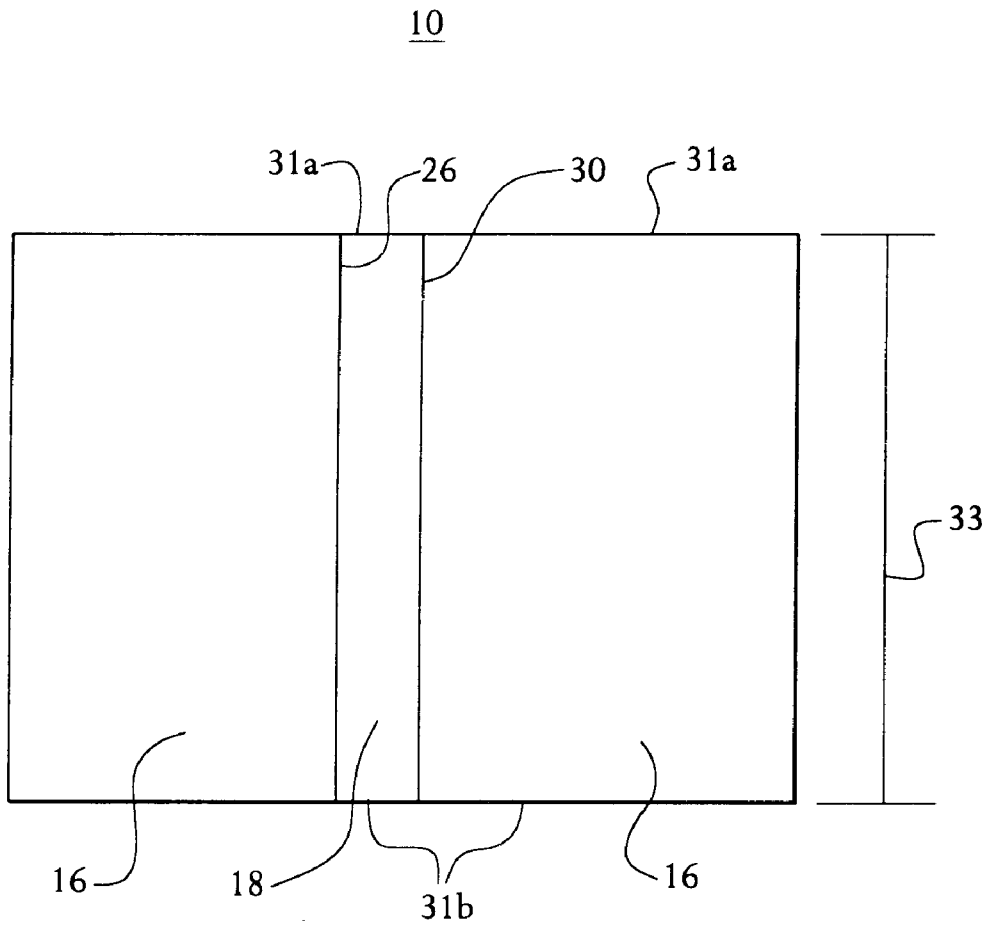
FIG. 1A is a side view of the flameless thermal oxidizer of FIG. 1.

FIG. 1A shows a side view of flameless thermal oxidizer 10 in FIG. 1. The first coiled sidewall 16 and second coiled sidewall 18 each have a longitudinal end 31*a* and a second longitudinal 31*b* that are spaced apart by a height 33 of the coiled sidewalls 16 and 18.

Although FIG. 1 shows the flameless thermal oxidizer 10 having two coiled sidewalls, the device of the present invention may have as many coiled sidewalls as desired, provided that the device has at least one inlet and at least one outlet for the gas stream to enter and exit the device. For example, the device preferably has at least two coiled sidewalls, more preferably from about 2 to about 6 coiled sidewalls, and most preferably from about 2 to about 4 coiled sidewalls.

Figure 2:
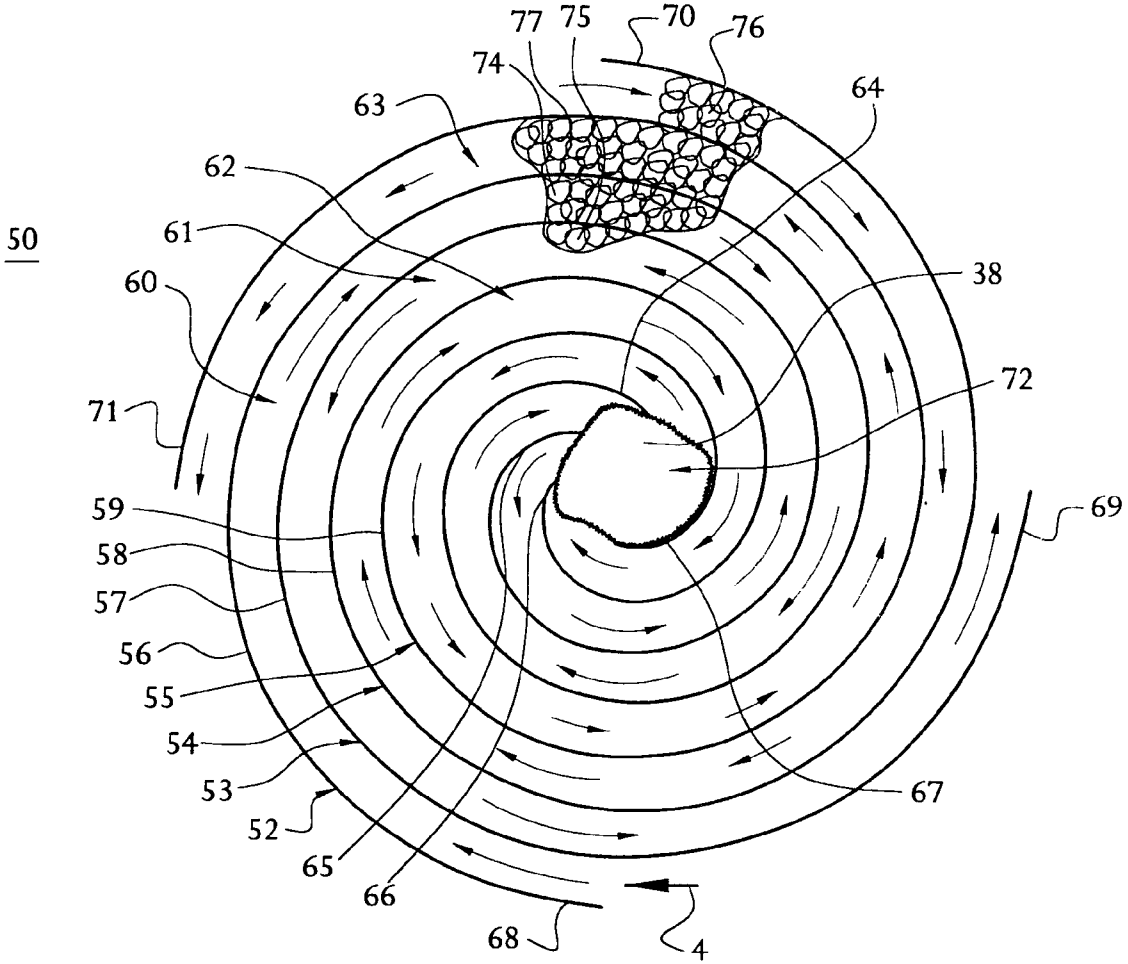
FIG. 2 is a view of the interior of another embodiment of the flameless thermal oxidizer according to the present invention.

Referring to FIG. 2 to illustrate a second embodiment of the present invention, a multiple passage flameless thermal oxidizer 50 comprises a first sidewall 52, a second sidewall 53, a third sidewall 54, and a fourth sidewall 55. Sidewalls 52, 53, 54, and 55 preferably are each formed into a first coiled sidewall 56, a second coiled sidewall 52, a third coiled sidewall 58, and a fourth coiled sidewall 59, respectively, which are mutually interspaced apart to form spiral inlet passages 60 and 62, and spiral outlet passages 61 and 63. Spiral passages 60, 61, 62 and 63 direct a gas stream 4 therethrough.

Each sidewall 52, 53, 54, and 55 has an interior end 64, 65, 66, and 67, respectively, disposed at the inner end of coiled sidewalls 56, 57, 58, and 59. Each sidewall 52, 53, 54, and 55 has an exterior end 68, 69, 70, and 71, respectively, disposed at an outer end of coiled sidewall 56, 57, 58, and 59. Interior ends 64, 65, 66, and 67 are mutually spaced apart to form chamber 72, which is in flow communication with each one of the passages 60, 61, 62, and 63 to direct the gas stream from spiral inlet passages 60 and 62 to spiral outlet passages 61 and 63. Although interior ends 64, 65, 66, and 67 are shown as curved in FIG. 2, the present invention encompasses these ends having other shapes (for example, tangential) to define various shapes of chamber 72.

Spiral inlet passages 60 and 62 preferably are interspaced between spiral outlet passages 61 and 63. The present invention encompasses passages 60, 61, 62, and 63 having other shapes, sizes, and orientations. For example, one of the four passages may be utilized as a spiral inlet passage while the remaining three passages may be used as spiral outlet passages to accommodate the increased volumetric flow rate associated with the higher temperature of the exiting gas stream. Further, the selection of the width, geometry, and length (measured along the spiral path) of the passages 20, 22, 60, 61, 62, and 63 may be chosen based on combustion and heat transfer characteristics of the flameless thermal oxidizer, inlet gas composition properties, and desired gas output, as will be understood by those familiar with such considerations. For example, a passage may vary in width for volumetric flow rate, heat transfer, and oxidation process considerations.

The following discussion applies both to flameless thermal oxidizer 10, shown in FIG. 1, and flameless thermal oxidizer 50, shown in FIG. 2. For clarity, reference numerals of the first embodiment (shown in FIG. 1) will be primarily used in the following description and the reference numerals of the second embodiment (shown in FIG. 2), where applicable, will be enclosed in parenthesis.

Preferably, coiled sidewalls 16 and 18 (52, 53, 54, and 56) smoothly and continuously bend around approximately the centroid (i.e., the center-most portion) of the flameless thermal oxidizer 10 (50) to form chamber 32 (72). The chamber 32 (72) of the thermal flameless oxidizer 10 (50) may be for example a core tube located at the centroid that is in flow communication with spiral passages 20 and 22 (60, 61, 62, and 63). However, the invention is not limited to this embodiment in which chamber 32 (72) is located at the centroid of flameless thermal oxidizer 10 (50). Specifically, the present invention encompasses devices having substantially elliptical shapes, convoluted passages, non-symmetrical shapes, passages of varying widths, and other shapes that vary the location of chamber 32 (72) within the broad scope of the claims.

Figure 4:
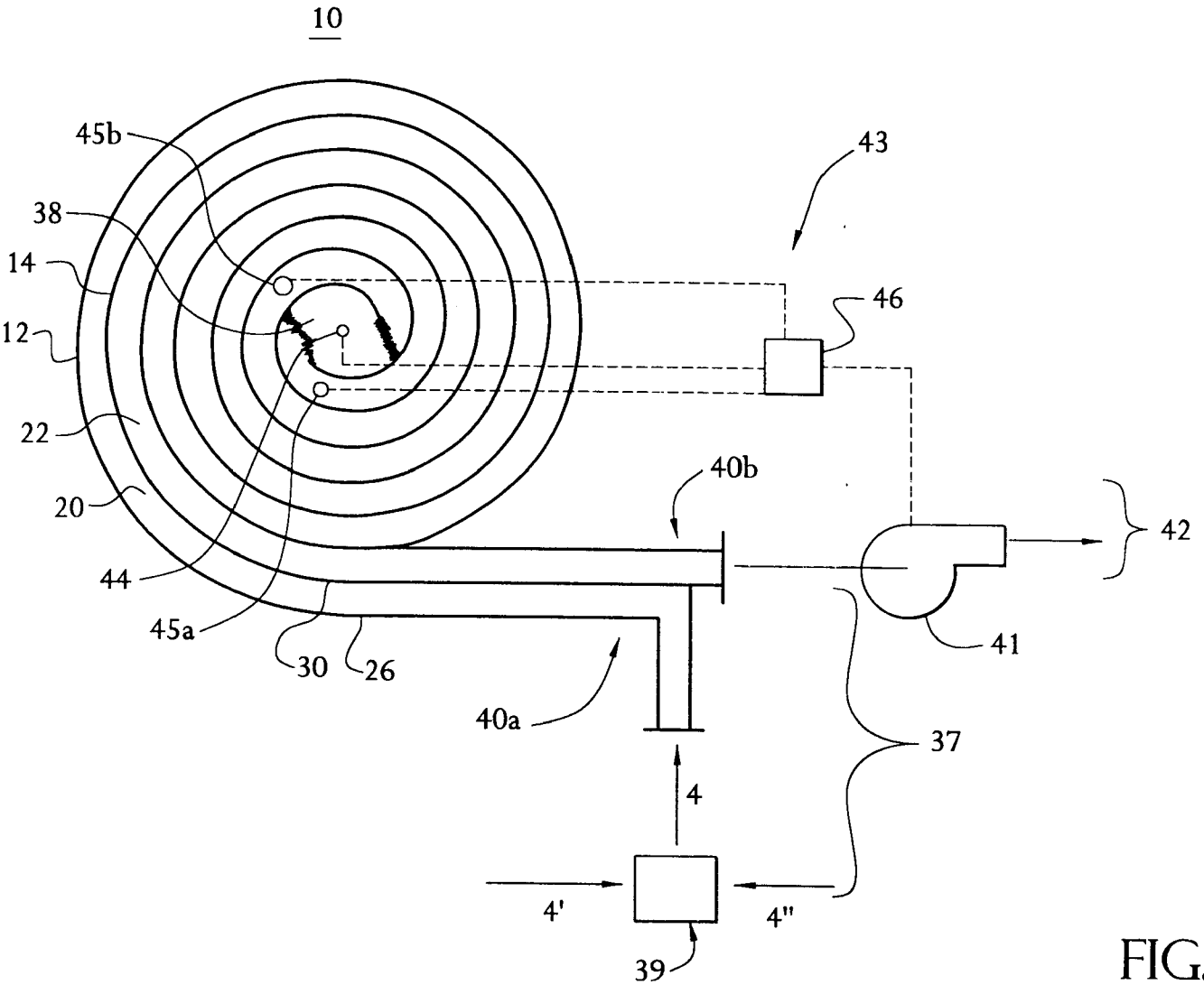
FIG. 4 is a schematic diagram illustrating a flameless thermal oxidizer employing ancillary devices according to the present invention.

Spiral inlet passage 20 (60, 62) and spiral outlet passage 22 (61, 63) mutually wind around chamber 32 (72) for a spiral path length that is dictated by heat transfer and process variable considerations, as will be apparent to those familiar with such consideration. Preferably, spiral inlet passage 20 is disposed radially outside of spiral outlet passage 22. As best shown in FIG. 4, sidewalls 12 and 14 (52, 53, 54, and 55) form a substantially tangential section proximate to exterior ends 26 and 30 (68, 69, 70, and 71).

As shown in FIGS. 1 and 2 a matrix 34 (74, 76) is preferably disposed within spiral inlet passage 20 (60, 62) and another matrix 36 (75, 77) is preferably disposed within spiral outlet passage 22 (61, 63). Chamber 32 (72) also preferably includes a matrix. The matrix in the chamber 32 (72) and in each of the spiral passages 20,22 (60, 61, 62, and 63) may be the same or different. Matrices 34 and 36 (74, 75, 76, and 77) are preferably formed of heat resistant porous inert media. Specifically, matrices 34, 36 (74, 75, 76, and 77) preferably comprise a bed of solid, heat-resistant inert porous media through which the gas stream passes. The media of matrices 34 and 36 (74, 75, 76, and 77) may encompass a bed of any ceramic, metal, or other heat-resistant media, including: metal wool; balls, preferably approximately ⅜" diameter; saddles, preferably approximately 0.5" nominal size; pall rings; metal or ceramic foam, preferably having a void fraction of approximately 90% and about ten to one hundred pores per inch; and honeycomb. Metal wool or foam matrices are preferred. In a preferred embodiment of the present invention, the chamber 32 (72) has disposed therein matrix media of ceramic foam or metal foam, and at least one of the spiral passages has disposed therein metal wool matrix.

Although FIGS. 1 and 2 generally use balls to represent the media, the present invention encompasses any combination of the above types and sizes of media, whether separately or in combination, and whether randomly or structurally arranged. Further, the media may include an engineered matrix portion that has two or more flow control portions. The materials of the media are chosen according to their heat transfer properties. The size, composition, and material selections are determined to obtain a desired overall heat transfer characteristic. See also, for example, U.S. patent application Ser. No. 08/921,815, entitled "Matrix Bed for Generating Non-Planar Reaction Wave Fronts and Method Thereof," filed Sep. 2, 1997, now U.S. Pat. No. 5,989,010, and U.S. patent application Ser. No. 08/922,176, entitled "Method of Reducing Internal Combustion Engine Emissions, and System for Same," filed Sep. 2, 1997, now U.S. Pat. No. 6,003,305, which are each assigned to the assignee of the present invention and incorporated herein by reference in their entireties, for further description of engineered matrix and media useful in the present invention.

The media of matrices 34 and 36 (74, 75, 76, and 77), which are shown for clarity, only in a cut away portion of flameless thermal oxidizer 10 (50) in FIGS. 1 and 2, preferably are disposed throughout passages 20 and 22 (60, 61, 62, and 63) and chamber 32 (72). The present invention also encompasses matrices 34 and 36 (74, 75, 76, and 77) disposed only in portions of flameless thermal oxidizer 10 (50) to achieve desired thermal and heat transfer properties, as will be understood by persons familiar with such properties and devices. Specifically, a matrix may be disposed only in selected portions of the spiral inlet passage 20 (60, 62), the spiral outlet passage 22 (61, 63), chamber 32 (72), or any combination thereof Referring to FIG. 3 to illustrate a third embodiment of the present invention, a heat exchanger 80 has some structural aspects that are similar to flameless thermal oxidizer 50. Heat exchanger 80 has a first sidewall 52, a second sidewall 53, a third sidewall 54, a fourth sidewall 55, a first coiled sidewall 56, a second coiled sidewall 57, a third coiled sidewall 58, and a fourth coiled sidewall 59. Second coiled sidewall 57 and fourth coiled sidewall 59 have interior ends 65 and 67, respectively. Coiled sidewalls 56, 57, 58, and 59 are interspaced apart to define first spiral passage 90, second spiral passage 91, third spiral passage 92, and fourth spiral passage 93. Heat exchanger 80 may also include a matrix (not shown in FIG. 3 for clarity) like that described with respect to FIG. 2.

Unlike flameless thermal oxidizer 50, heat exchanger 80 has a means for directing the gas stream through the spiral inlet passages 60, 62 and to the spiral outlet passages 61, 63 that includes a transition sidewall 82 that preferably continuously connects the interior end 64 of first coiled sidewall 56 and the interior end 66 of third coiled sidewall 58 in the interior of heat exchanger 80. The transition sidewall 82 is connected in a manner to first coiled sidewall 56 and third coiled sidewall 58 such that two separate loops 94, 95 are formed.

The first loop 94 enables first spiral passage 90 to be only in flow communication with second spiral passage 91. The second loop 95 enables third spiral passage 92 to be only in flow communication with fourth spiral passage 93. Preferably, as shown in FIG. 3, first loop 94 lacks communication with second loop 95 to enable device 80 to transfer heat between the gas stream 4 and a fluid stream 6 without mixing between gas stream 4 and fluid stream 6.

Figure 3:
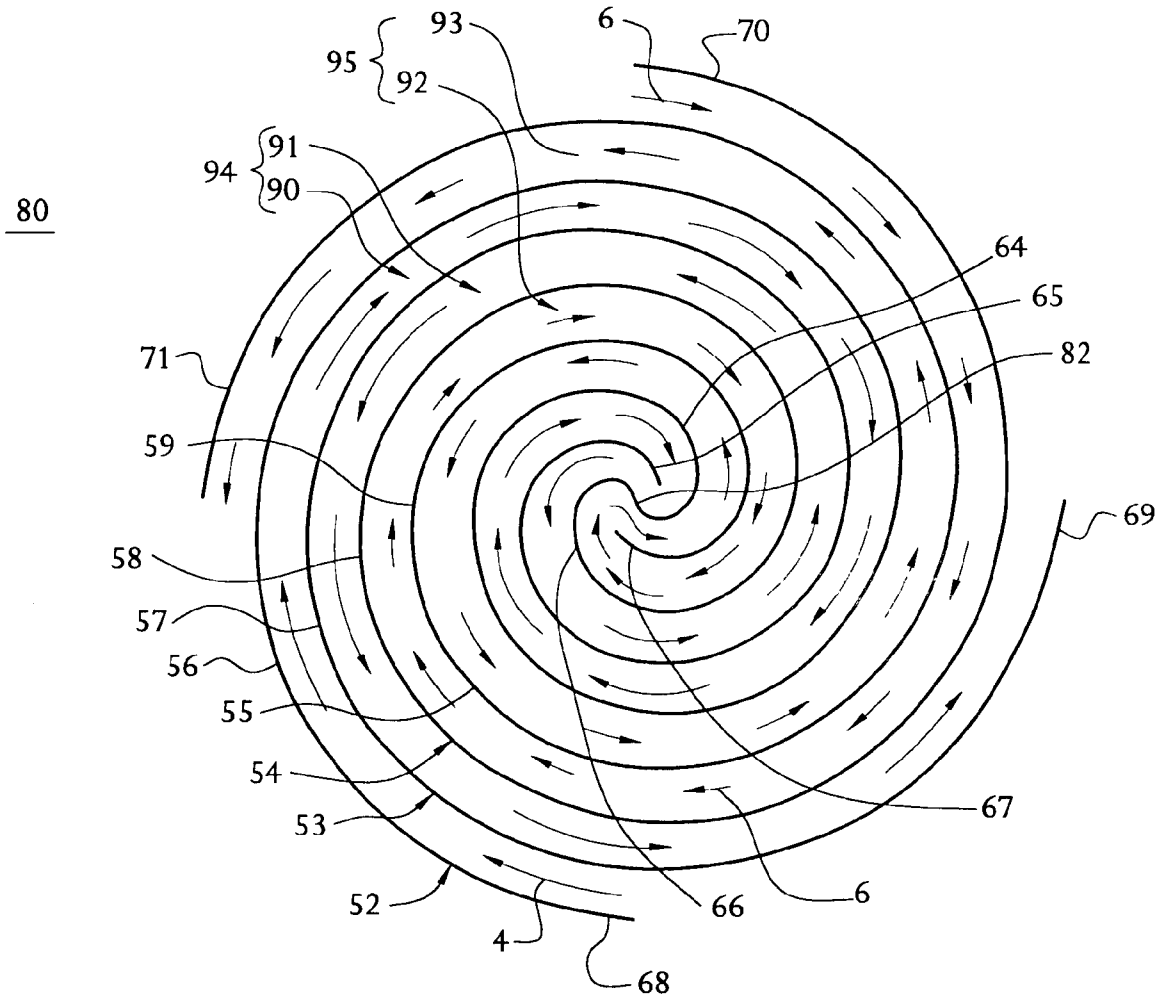
FIG. 3 is a view of the interior of a heat exchanger according to the present invention.

Although FIG. 3 shows transition sidewall 82 being used with a device having four coiled sidewalls, one or more transition sidewalls can be used with a device having at least three coiled sidewalls. In such a device, at least one transition sidewall may be used to connect the interior ends of any two coiled sidewalls to form at least one loop that connects at least one spiral inlet passage to at least one spiral outlet passage so that the spiral inlet and outlet passages are in flow communication with each other. Preferably, the transition sidewall is used to connect two nonadjacent coiled sidewalls. By "nonadjacent" it is meant that at least one coiled sidewall is disposed between the two coiled sidewalls that are being connected at the interior ends. Preferably the coiled sidewalls are connected in a manner so that the one or more loops formed lack flow communication with each other and any other spiral passages in the device. For example, a spiral shaped device having 3 coiled sidewalls, using one transition sidewall, could have one loop being formed to connect a spiral inlet passage to a spiral outlet passage. The remaining spiral passage in the device could be for example in flow communication with a separate outlet. A preferred embodiment is that as shown in FIG. 3 where the spiral shaped device (heat exchanger 80) has at least four coiled sidewalls, at least two separate loops, and at least one transition sidewall that connects the interior ends of two nonadjacent coils. Moreover in the embodiment shown in FIG. 3, instead of using transition sidewall 82 to connect the interior ends 64, 66 of first and third coiled sidewalls 56 and 58, the transition sidewall 82 could be used to connect the interior ends 65, 67 of second and fourth coiled sidewalls 57 and 59 to form two loops.

FIG. 4 illustrates ancillary devices and systems that may be employed with flameless thermal oxidizer 10 (50). Ancillary devices that may be used include for example an inlet assembly 37, an outlet assembly 42, and a control system 43. These ancillary devices are equally applicable to heat exchanger 80 and other embodiments of the spiral shaped device of the present invention. However, modifications to these ancillary devices may need to be made to adapt the ancillary device to the particular embodiment of the spiral shaped device being used. For example, inlet assembly 37 used with multiple passage flameless thermal oxidizer 50 requires more piping to accommodate the second inlet passage and second outlet passage.

Inlet assembly 37 is used to direct the gas stream into the spiral shaped device and may include for example a means for mixing the gas stream with other components. In FIG. 4, the inlet assembly 37 is disposed proximate to an exterior portion of sidewalls 12 and 14 and is coupled to exterior ends 26 and 30 so as to communicate with spiral inlet passage 20. Inlet assembly 37 includes inlet piping 40*a* and an inlet plenum 39 that enables mixing of an oxidant stream 4' such as air and a thermally oxidizable (including combustible) gas stream 4" to form gas stream 4. In addition to oxidant stream 4' it may be desired to add other streams (not shown) to the inlet plenum 49 such as a fuel or a coreactant to the inlet plenum 39 in forming gas stream 4. Inlet assembly 37 may include a piping manifold (not shown) rather than plenum 39.

Outlet assembly 42 is used to direct the gas stream out of the spiral shaped device. In FIG. 4, the outlet assembly 42 is disposed proximate to an exterior portion of sidewalls 12 and 14 and is coupled to exterior ends 26 and 30 so as to communicate with spiral outlet passage 22. Outlet assembly 42 includes outlet piping 40*b*, a discharge fan 41, and gas treatment equipment (not shown) as required by the particular application.

Control system 43 is used to control the oxidation reaction within the flameless thermal oxidizer 10. The control system 43 includes a heater 44, plural temperature sensors 45*a* and 45*b*, and a controller 46. Heater 44, temperature sensors 45*a* and 45*b*, and fan 41 are in informational communication with controller 46. Preferably, heater 44 is disposed at or near the centroid of chamber 32 (72).

Heater 44 may comprise for example an electric arc ignitor, or a resistive heating element that protrudes into matrix 34 and/or 36 (74, 75, 76, and/or 77). Alternatively, heater 44 may be formed by an electrically conductive portion (not shown), preferably comprising a metal foam, within matrix 34 and/or 36 (74, 75, 76, and/or 77), through which electricity may pass so as to function simultaneously as a resistance heating element and as a portion of the reaction matrix. Such an electrically conductive portion may be formed in any shape that is conductive to proper heat transfer and electrical function. For example, the heater 44 may comprise a metal foam disposed a straight path extending through the flameless thermal oxidizer 10, (50) parallel a center axis that is perpendicular to the plane defined by the flow directions shown in FIG. 1. Heater 44 may heat matrix 34 and/or matrix 36 (74, 75, 76, and 77), or may directly heat process gas stream 4.

In place of, or in addition to heater 44, flameless thermal oxidizer 10, (50) may include an external burner (not shown), which may be employed in at least two ways. First, the burner may initiate reaction of gas stream 4 by preheating matrix 34 and/or 36 (74, 75, 76, and/or 77). Second, the burner may be used to heat chamber 32 (72) to help maintain the oxidation reaction. The latter function may be particularly useful for a gas stream having a low or rapidly varying heating value.

For clarity, two sensors 45*a* and 45*b* are shown, although three or four are preferred. Temperature sensors 45*a* and 45*b* preferably are thermocouples that protrude into matrix 34 and/or 36 (74, 75, 76, and/or 67) at successive locations along the flow path of process stream 4. Although thermocouples are preferred, temperature sensors 45*a* and 45*b* may comprise any transducer that forms a signal that represents temperature, including, for example, optical temperature sensors and sensors that measure the temperature of sidewalls 12 and 14 (52, 53, 54, and 55) rather than the temperature within matrix 34 and/or 36 (74, 75, 76, and/or 77).

Fan 41, which induces flow through the device 10 (50), comprises a conventional device that is controlled by controller 46. Fan 41 may include a tempering air damper (not shown) that is also controlled by controller 46. The present invention may comprise any device to force gas stream 4 to flow, including for example, a natural draft, or positive pressure fans on the inlet side of device 10 (50). Further, if gas stream 4 has sufficient pressure to satisfy the process requirements, the device 10 (50) may be employed without fan 41, and controlled by conventional methods and devices.

In a preferred embodiment of the present invention, plural dimples may be formed on at least a portion of one or more coiled sidewalls of the device of the present invention. More preferably, the dimples are formed on a portion of at least two of the coiled sidewalls. The dimples may be used for several purposes. For example, the dimples may extend into at least one of the spiral passages to enhance convective heat transfer between the gas stream and the sidewalls by increasing sidewall surface area and surface roughness. The dimples may also be used to provide the desired spacing between coiled sidewalls. Also, for example, the dimples may aid in spacing the coiled sidewalls uniformly throughout the device.

Figure 5:
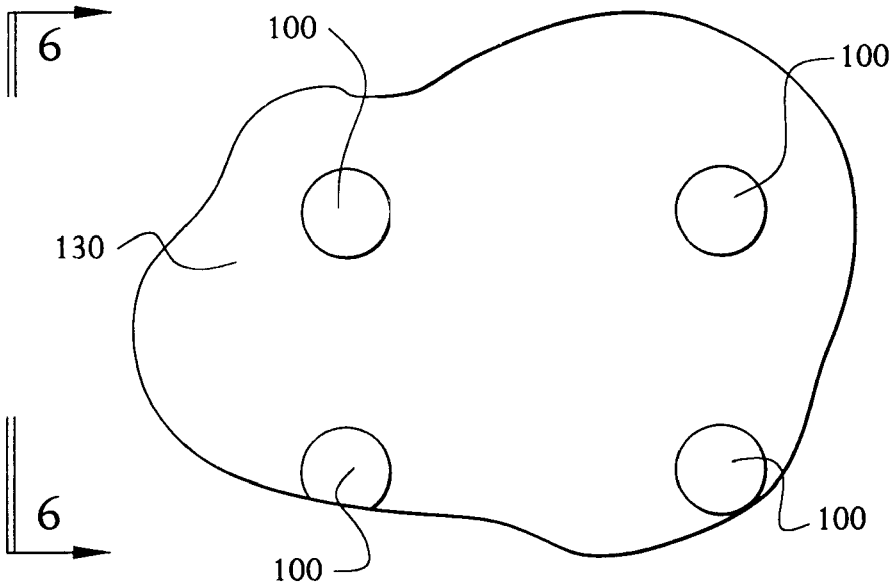
FIG. 5 is a view of dimples according to an aspect of the present invention.
Figure 6:
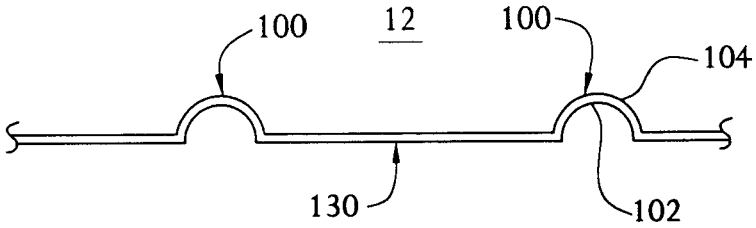
FIG. 6 is a sectional view of FIG. 6.

FIGS. 5 and 6, in connection with FIG. 1, show an embodiment of using dimples. In FIGS. 5 and 6, plural dimples 100 are formed on the surface 130 of sidewall 12. The dimples may be formed by a rounded or hemispherical-tipped punch driven by mechanical or hydraulic pressure to create a concave side 102 and a convex side 104. Dimples 100 may be formed on sidewall 12 and/or sidewall 14 before or after winding into coils. For example, dimples 100 may space apart sidewalls 12 and 14 during the winding process to create passages 20 and 22 of a desired spacing.

The size of each one of the dimples 100 may vary according to the particular application, process parameters, and like variables. As an example, dimple size might range in diameter from 0.5 to 2 inches, and the height of the raised portion might range from 0.03125 to 0.5 inches. Although circular dimples are shown in FIGS. 5 and 6, the present invention encompasses dimples formed of various shapes, including for example, elliptical, cylindrical, conical, pointed, and star-like shapes.

Figure 7:
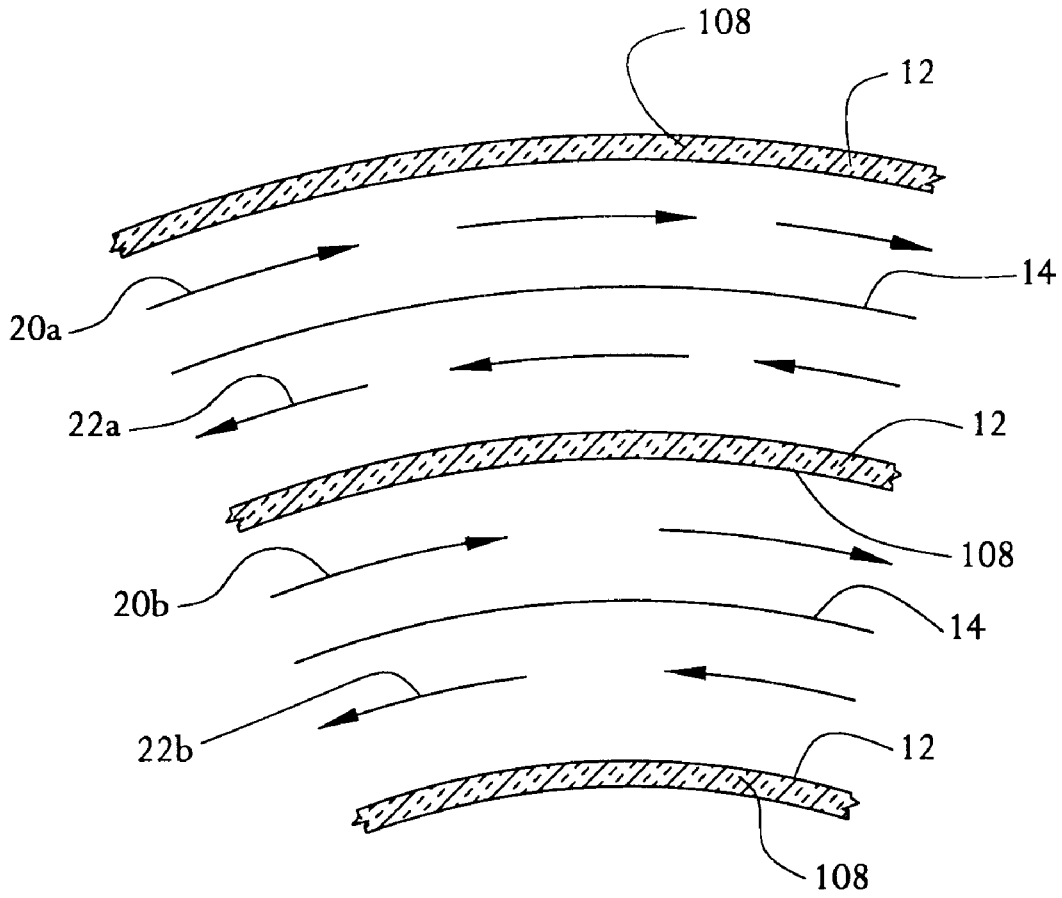
FIG. 7 is a view of a portion of the flameless thermal oxidizer according to another aspect of the present invention.

FIG. 7, in connection with FIG. 1, illustrates another preferred embodiment of the present invention where an insulation layer disposed on at least one sidewall is used to increase the overall heat transfer effectiveness of the device. In FIG. 7, spiral inlet and outlet passages 20 and 22 have been further identified with a and b designations to clarify the description relating to heat transfer between spiral inlet and outlet passages 20 and 22. In FIG. 7, an insulation layer 108 disposed on sidewall 12 is used to inhibit heat transfer from a spiral inlet passage having a higher gas stream temperature than an adjacent spiral outlet passage. Particularly, spiral inlet and outlet passages 20*b* and 22*b* are located closer to the centroid of flameless thermal oxidizer 10 (50) and have a higher gas stream temperature in comparison to spiral inlet and outlet passages 20*a* and 22*a*. The insulation layer 108 is employed on the surface of first sidewall 12 substantially continuously along its angular length. Insulation layer 108 inhibits heat transfer from the relatively hot gas in the spiral inlet passage 20*b* to the relatively cool gas in the spiral outlet passage 22*a* in a substantially radial direction. Second sidewall 14 lacks such an insulation layer to allow heat transfer from spiral outlet passage 22*a* to spiral inlet passage 20*a* and also heat transfer from spiral outlet passage 22*b* to spiral inlet passage 20*b*.

The insulation layer disposed on at least one sidewall may be used in other embodiments of the present invention to inhibit undesirable heat transfer and thus increase the overall heat transfer effectiveness of the device as would be recognized by one skilled in the art. For example, in devices having 3 or more coiled sidewalls, the insulation layer 108, is preferably disposed on alternating coiled sidewalls (such as first and third coiled sidewalls 56 and 58 in FIG. 2). Insulation layer 108 may be formed by conventional means that are suited for the temperature, chemical, and mechanical environment of the particular application, as will be understood by persons familiar with insulation materials and the particular application environment.

The device of the present invention may also employ both insulation layer 108 and dimples 100. For example, insulation layer 108 and dimples 100 may be employed on alternate sidewalls. Particularly, referring to FIGS. 1, 5, 6, and 7, first sidewall 12 may employ insulation layer 108 to inhibit heat transfer across sidewall 12, while second sidewall 14 may employ dimples 100 to enhance heat transfer across sidewall 14. Also, for example, both dimples 100 and insulation layer 108 may be applied to a sidewall to aid in spacing the coiled sidewall from the other coiled sidewalls and for inhibiting heat transfer across the coiled sidewall.

Figure 8:
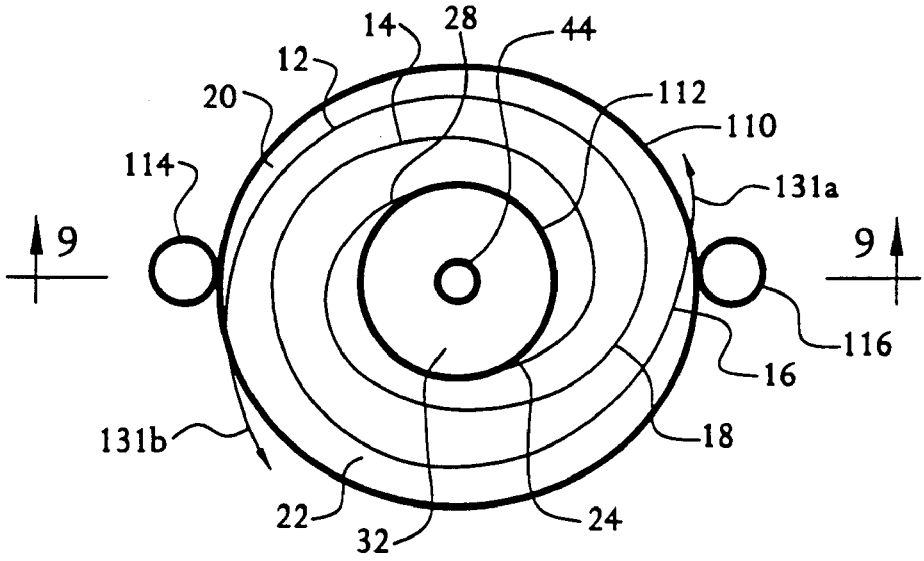
FIG. 8 is a view of the flameless thermal oxidizer according to another aspect of the present invention.

Referring to FIG. 8, which shows a cross sectional view of a flameless thermal oxidizer 10 with the media removed for clarity, illustrates an example of the structure of a device of the present invention. Flameless thermal oxidizer 10 may be constructed of an exterior tube 110, a core tube 112, an inlet tube 114, and an outlet tube 116. Exterior tube 110 defines the outermost boundary of the flameless thermal oxidizer 10 and core tube 112 defines chamber 32. Tubes 112, 114, and 116 have radial openings therein to enable gas stream 4 to pass continuously therethrough. As an example of the dimensions of flameless thermal oxidizer 10, external tube 110 may be 18 inches in diameter by 16 inches in height. The core tube 112 may be an 8 inch diameter pipe of AL6XN alloy having two 3 inch wide and 12 inch high diametrically-opposed, slit openings (not shown) to provide openings for spiral passages 20 and 22 to chamber 32. The flameless thermal oxidizer 10 may have sidewalls with 5 turns constructed of 24 gauge 310 stainless steel. The spacing between coiled sidewalls 16 and 18 may be 0.75 inches (although 0.375 inch spacing is common), and may be maintained by fastening nuts in the passages, or by other means explained below. The sidewalls 12 and 14 may be fastened to the exterior tube 110 by feeding the sidewall 12 and 14 through thin slits (not shown) in tube 110. Ceramic coatings and liners may also be employed in the construction of the device.

In another preferred embodiment of the invention, the spiral shaped device of the present invention includes at least one seal that maintains contact with the longitudinal ends of the coiled sidewalls when the coiled sidewalls thermally expand. Under high temperatures, thermal expansion of the coiled sidewalls is possible in all directions (such as longitudinal, transverse, and angular), and without proper precautions, can cause the device to undesirably leak, such as between spiral passages. The seal useful in the present invention is especially adapted to maintain a seal with one or both longitudinal ends of the spiral shaped device when the device is subject to thermal expansion.

Figure 9:
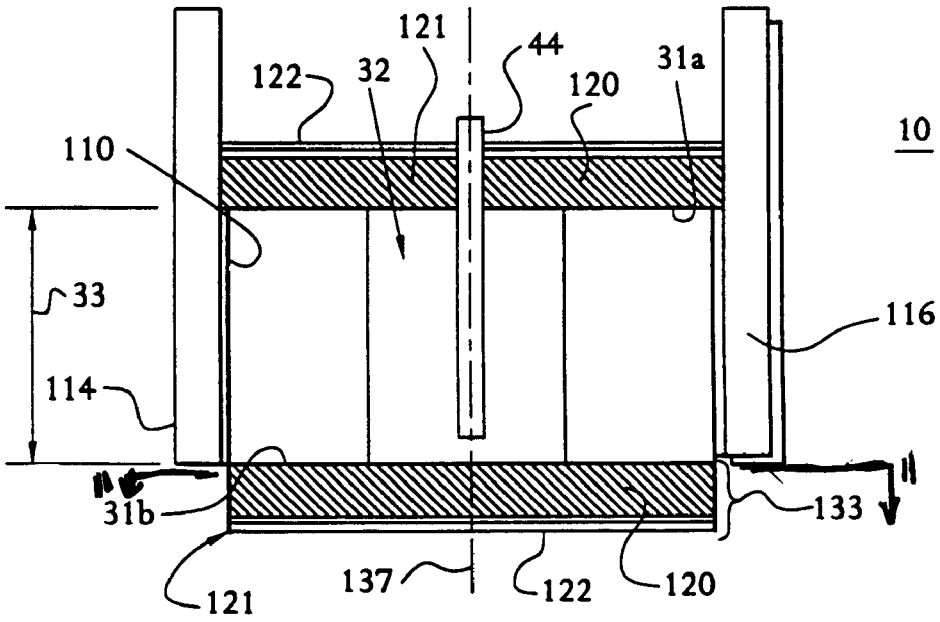
FIG. 9 is a sectional view of the flameless thermal oxidizer to illustrate another aspect of the present invention.
Figure 11:
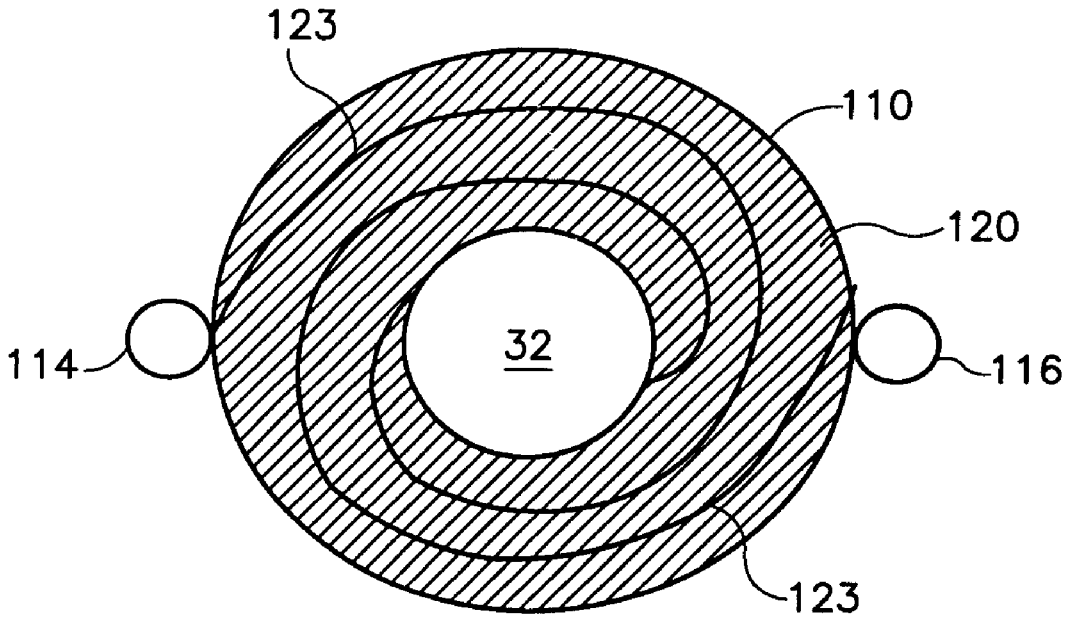
FIG. 11 is a sectional view of the compressible member, taken through lines 11—11 in FIG. 9, to illustrate another aspect of the present invention.

FIG. 9 is a sectional view of flameless thermal oxidizer 10 that illustrates a type of seal 133 that is adapted to handle thermal expansion of the device. The seal 133 in FIG. 9 includes a compressible member 120, that is disposed at longitudinal ends 31*a* and 31*b* of coiled sidewalls 16 and 18 (not shown). Compressible member 120 preferably is formed of ceramic fiber board insulation such as A.P. Green Insu-board, although any compressible material that is suitable to withstand the temperature, mechanical, and chemical conditions is encompassed by the invention. The seal 133 may also include a support means 122, such as a bolted metal plate, that is located adjacent to the compressible member 120. Preferably, the compressible member 120 has at least one spiral groove 123, as shown in FIG. 11, that is formed by at least one coiled sidewall compressing into compressible member 120. The spiral groove inhibits transverse (that is, substantially orthogonal to the longitudinal axis 137 of device 10) displacement of the coiled sidewalls 16 and 18, while allowing thermal expansion in an angular direction (131*a* and 131*b* in FIG. 8) of coiled sidewalls 16 and 18. Particularly, sidewalls 12 and 14, which are preferably fixed at interior ends 24 and 28, can slide along the spiral groove in compressible member 120 and maintain tight contact with compressible member 120 as the coiled sidewalls 16 and 18 expand in an angular direction 131*a* and 131*b*. As an example of the amount of angular growth caused by thermal expansion for a typical thermal oxidation process, a sidewall that is 27 feet long could grow by approximately 3 inches at the unfixed end.

Figure 10:
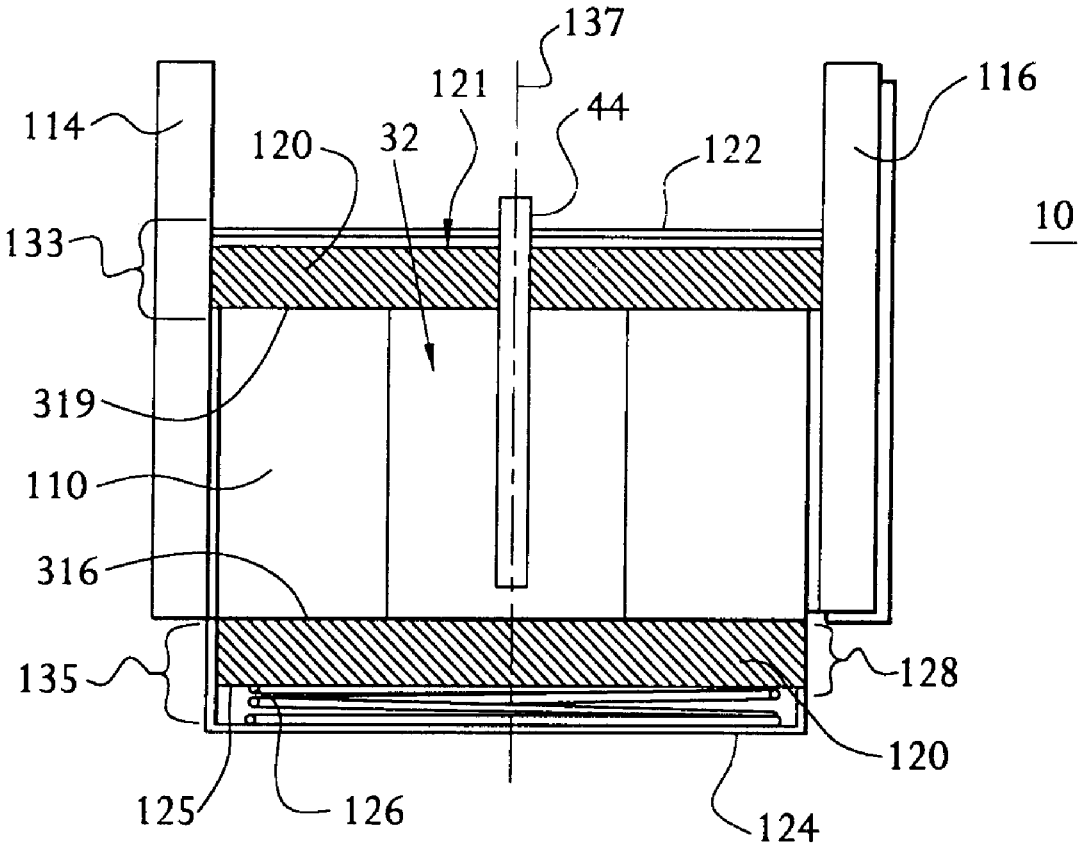
FIG. 10 is a sectional view of the flameless thermal oxidizer to illustrate another aspect of the present invention.

FIG. 10 illustrates another device for providing sealing for the longitudinal ends 31*a* and 31*b* of sidewalls 12 and/or 14 (not shown). Such a seal 135 includes a reference member, such as a metal housing 124, a biasing member, such as a helical spring 126, and a contact member 128. The contact member 128 preferably includes a compressible member 120, a washer 125 which is disposed on compressible member 120, and a gasket (not shown) which spring 126 urges. Spring 126 biases contact member 128 against longitudinal end 31*b* of sidewalls 12 and 14. The compressible member 120 may compress to receive differential thermal expansion of the interior and exterior portions of the sidewalls 12 and 14. Preferably, metal housing 124, washer 125, and spring 126 are formed by a "Bellville Washer," as available from J. H. Rosenbeck, Inc. 2170 Winstead Road, Torrington Conn.

The device of the present invention may employ a combination of sealing devices. For example, as illustrated in FIG. 10, seal 135 (spring based) and seal 133 may be used in one device. Further, the present invention encompasses employing seal 133 or seal 135 at one longitudinal end of the coiled sidewall, and having a fixed end (e.g., a metal plate) at the opposing longitudinal end of the coiled sidewall.

The dimensions of the embodiments of the invention described herein will vary according to process parameters, materials and other variables particular to the application, as will be understood by those skilled in the art and familiar with such parameters, variables, applications and the like. Further, although FIGS. 4 through 10, as well as the description pertaining thereto, use the embodiment shown in FIG. 1 for reference, the information and/or inventive aspects described in FIGS. 4 through 10 apply also to the embodiments shown in FIGS. 2 and 3.

The method according to the present invention will now be described in conjunction with a description of the operation of the device, with reference to FIG. 4. For convenience, the description of the operation of the present invention uses flameless thermal oxidizer 10 for reference. Reference numerals of multiple passage flameless thermal oxidizer 50 are included in parentheticals, where applicable, to simultaneously describe the operation of flameless thermal oxidizer 50.

A gas stream 4 is formed by combining an oxidant stream 4', such as air, with a thermally oxidizable gas stream 4" in inlet plenum 39. Thermally oxidizable gas stream 4" may comprise for example oxidizable organic material such as organic particulate matter, volatile organic compounds, hydrocarbons, or products of incomplete combustion, (e.g., carbon monoxide). In a preferred embodiment, the gas stream 4 may be a lean gas mixture. Preferably, the lean gas mixture contains less than about 2.5 weight percent, and more preferably less than about 0.7 weight percent oxidizable or combustible material based on the total weight of the gas stream 4. In another preferred embodiment, gas stream 4" may have its heating value augmented by adding a fuel stream (not shown), according to the process requirements of the oxidizer or other thermal parameters. As will be apparent to one skilled in the art, if the device of the present invention is used for other purposes such as a reactor, it may be desired to use inlet plenum 39 to mix coreactants prior to entering spiral inlet passage 20 (60, 62).

Following formation, gas stream 4 passes through inlet assembly 37 into inlet passage 20 (60, 62) of flameless thermal oxidizer 10 (50). Gas stream 4 passes through spiral inlet passage 20 (60, 62), through matrix 34 (74, 76), and into chamber 32 (72). Gas stream 4 flows from chamber 32 (72) through spiral outlet passage (22) (61, 63).

Heater 44 initiates an exothermic oxidation reaction among gas constituents of gas stream 4 in a reaction zone to form a reaction wave 38, as shown in FIGS. 1, 2 and 4. Reaction wave 38 preferably occupies the entire chamber 32 (72) as shown in FIG. 4, although the reaction wave 38 may be formed within spiral inlet passage 20 (60, 62), within spiral outlet passage 22 (61, 63), or any combination thereof with chamber 32 (72). The reaction wave is preferably flameless, occurring outside normal flammability limits of a reaction mixture containing air or oxygen. The initiation and control of a flameless reaction wave can be accomplished by techniques well known to those skilled in the art such as those techniques disclosed in U.S. Pat. No. 5,165,884 to Martin, et al., and U.S. Pat. No. 5,320,518 to Stilger, et al., both of which are incorporated by reference herein in their entireties.

After initiation, reaction wave 38 preferably is self-sustaining within matrix 34 and/or 36 (74, 75, 76, and/or 77). The location and temperature of reaction wave 38 may be ascertained by the signals from temperature sensors 45*a* and 45*b*. Controller 46 may maintain or adjust the location or size of reaction wave 38 in response to the temperature signals, by various means. For example, controller 46 may control the reaction wave 38 by adjusting the flow rate of gas stream 4 by means such as changing the position of dampers (not shown) disposed in inlet assembly 37. Controller 46 may also control reaction wave 38 by changing the fan speed on fan 41 to cause greater negative pressure in flameless thermal oxidizer 10 (50), adjusting a fan damper (not shown), adjusting the flow rate of oxidant stream 4' and/or thermally oxidizable gas stream 4" by inlet flow control means (not shown), adjusting an auxiliary fuel component of gas stream 4" (not shown), or similar means that will be apparent to persons familiar with such processes. Further, controller 46 may also adjust the output of heater 44 to anchor (e.g., hold in place) reaction wave 38 or to augment the enthalpy of gas stream 4.

The media on the inlet side of reaction wave 38 is primarily heated by inner-body, backward-propagating radiation, which includes both the spiral (that is, angular) and radial directions. The incoming gas stream 4 is primarily heated by convection from the media to the gas. In addition to heat transfer in the direction of the flow, heat transfer occurs from the gas downstream of reaction wave 38 in outlet passage 22 (61, 63) to matrix 36 (75, 77). Heat transfer occurs from matrix 36 (75, 77), through sidewalls 12 and 14 (52, 53, 54, and 56), to matrix 34 (74, 76) and to gas stream 4 in inlet passage 20 (60, 62). Within reaction wave 38, convective and radiative heat transfer from the reaction wave to the media retards the creation of thermal NOx, thereby diminishing the NOx content of the process stream 4 at the outlet of flameless thermal oxidizer 10 (50) compared with open flame combustion.

The heat transfer characteristics of flameless thermal oxidizer 10 (50) may be varied by employing a matrix of different materials and sizes so as to change: the radiative properties, including the mean free radiative path and emissivity; the convective properties, including matrix surface area per unit volume and geometry; and the conductive properties, including thermal conductivity coefficients and heat capacities. Moreover, hollow zones may form an interface or several interfaces between the matrices or hollow zones may be employed so as to anchor reaction wave 38.

Referring to FIG. 3, the operation of heat exchanger 80 will be described. FIG. 3 shows a gas stream 4 passing through first loop 94 and a fluid stream 6 passing through second loop 95. The fluid stream may be any flowable material such as a liquid, gas, or flowable solid. To illustrate the flow pattern, fluid stream 6 is shown using a dashed line. The matrix is omitted from FIG. 3 for clarity. Preferably, gas stream 4 will have a different temperature (either higher or lower) than fluid stream 6. Therefore, heat transfer will occur between gas stream 4 and fluid stream 6 via the matrix disposed in first loop 94, sidewalls 52, 53, 54, and 55, and matrix (if present) disposed in second loop 95 according to the heat transfer modes described above. In the case where fluid stream 6 is a liquid or flowable solid, preferably the second loop does not contain matrix. Gas stream 4 and fluid stream 6 are induced to flow by convention means, such as an outlet fan.

The present invention may be embodied in other specific forms without departing from the spirit or essential attributes thereof and, accordingly, reference should be made to the appended claims, rather than to the foregoing specification, as indicating the scope of the invention.

What is claimed is:

1. A device for thermal processing of a gas stream, comprising:

a structure having at least two coiled sidewalls that are interspaced apart, wherein each of the coiled sidewalls has an interior end and two longitudinal ends;

at least two spiral passages formed between the two coiled sidewalls for passing the gas stream through the structure, wherein at least one of the spiral passages is an inlet for the gas stream and at least another of the spiral passages is an outlet for the gas stream;

means, located at the interior ends of the coiled sidewalls, for directing the gas stream in the at least one spiral inlet passage to the at least one spiral outlet passage; and a matrix of heat resistant porous inert media disposed in at least a portion of the structure.

2. The device of claim 1 wherein the device has two coiled sidewalls and two spiral passages.

3. The device of claim 1 wherein the device has three coiled sidewalls and three spiral passages, wherein the third spiral passage is a second inlet or a second outlet for the gas stream.

4. The device of claim 1 wherein the device has four coiled sidewalls and four spiral passages.

5. The device of claim 1 wherein the device has at least three coiled sidewalls and at least three spiral passages and the means for directing the gas stream in the at least one spiral inlet passage to the at least one spiral outlet passage comprises at least one transition sidewall connecting the interior ends of two coiled sidewalls to form at least one separate loop that directs the gas stream from the spiral inlet passage to the spiral outlet passage.

6. The device of claim 5 wherein the device has at least four coiled sidewalls and at least four spiral passages, and wherein the at least one transition sidewall is connected to the interior ends of two nonadjacent coiled sidewalls to form at least two separate loops, wherein the first loop directs the gas stream through the structure and the second loop directs the fluid stream through the structure.

7. The device of claim 6 wherein the device comprises a heat exchanger for transferring heat between the gas stream flowing within the first loop and the fluid stream flowing within the second loop.

8. The device of claim 1 wherein the heat resistant porous inert media is selected from a group consisting of a random ceramic packing, ceramic balls, ceramic saddles, a structured ceramic packing, a ceramic foam material, a ceramic honeycomb shaped material, a metal matrix, a random metal packing, a structured metal packing, and an engineered matrix having a plurality of flow control portions that are defined by the linear gas velocity characteristics thereof.

9. The device of claim 1 wherein at least one of the coiled sidewalls has a surface comprising dimples, a portion of the dimples protruding into at least one of the spiral passages.

10. The device of claim 9 wherein the dimples contact at least one of the other coiled sidewalls for spacing apart at least two of the coiled sidewalls.

11. The device of claim 9 wherein at least two of the coiled sidewalls have surfaces comprising the dimples protruding into at least one of the spiral passages.

12. The device of claim 1 further comprising an insulation layer disposed on at least one of the coiled sidewalls for inhibiting heat transfer through at least one of the coiled sidewalls.

13. The device of claim 1 further comprising a seal for receiving thermal expansion of the coiled sidewalls, wherein the seal is in contact with at least one longitudinal end of the coiled sidewalls and comprises a compressible member and a means for supporting the compressible member.

14. The device of claim 13 wherein the compressible member comprises at least one spiral groove compressed therein by at least one of the coiled sidewalls to allow thermal angular expansion of the coiled sidewall while maintaining contact between the coiled sidewall and the compressible member.

15. The device of claim 1 further comprising a seal for receiving thermal expansion of the coiled sidewalls, wherein the seal is in contact with at least one longitudinal end of each of the coiled sidewalls and comprises a biasing member, a contact member, and a reference member, wherein the biasing member is coupled to the reference member and urges the contact member into contact with at least a portion of the longitudinal end of at least one of the coiled sidewalls.

16. The device of claim 15 wherein the contact member comprises a spiral groove compressed therein by each one of the coiled sidewalls to allow thermal angular expansion of the coiled sidewalls while maintaining contact between the coiled sidewalls and the contact member.

17. The device of claim 1 wherein the means for directing the gas stream in the at least one spiral inlet passage to the at least one spiral outlet passage is a chamber located proximate to the interior ends of the coiled sidewalls that is in flow communication with the spiral inlet passage and spiral outlet passage.

18. The device of claim 17 wherein the chamber is disposed at approximately the center of the structure.

19. The device of claim 17 further comprising at least one temperature sensor for measuring the temperature of the gas stream.

20. The device of claim 19 further comprising means for adjusting the flow rate of the gas stream, and a controller capable of accepting input from the temperature sensor and, in response thereto, controlling the means for adjusting the flow rate of the gas stream.

21. The device of claim 20 wherein the device comprises a flameless thermal oxidizer for destroying oxidizable components of the gas stream.

22. The device of claim 21 wherein at least a portion of the chamber comprises the matrix of heat resistant porous inert media.

23. The device of claim 22 wherein the matrix of heat resistant porous inert media in the chamber is ceramic foam or metal foam.

24. The device of claim 23 wherein at least a portion of at least one spiral passage comprises metal wool as the matrix of heat resistant material.

25. The device of claim 21 further comprising a heater, coupled to the structure, for heating the gas stream above the autoignition temperature of the gas stream.

26. The device of claim 25 wherein the heater comprises an electric resistance heater; a conductive portion of the matrix capable of receiving an electric current; a burner capable of providing hot gas; or an electric arc element.

27. The device of claim 26 further comprising an inlet assembly wherein the inlet assembly comprises an inlet plenum for mixing the gas stream with an oxidant, a fuel, a co-reactant, or combinations thereof.

28. A device for thermal processing of a gas stream, comprising:

a structure having at least two coiled sidewalls that are interspaced apart, wherein each of the coiled sidewalls has an interior end, an exterior end, and two longitudinal ends;

at least two spiral passages formed between the two coiled sidewalls for passing the gas stream through the structure, wherein at least one of the spiral passages is an inlet for the gas stream and at least another of the spiral passages is an outlet for the gas stream;

a core tube disposed proximate the interior ends of the at least two coiled sidewalls;

a chamber, formed within the core tube, that is in flow communication with each one of the spiral inlet passage and the spiral outlet passage; and a matrix of heat resistant inert media disposed in at least the chamber and bounded by the core tube.

29. The device of claim 28 wherein each of the interior ends of the at least two coiled sidewalls are coupled to the core tube, the core tube having openings formed therein for enabling flow communication therethrough.

30. The device of claim 29 further comprising an exterior tube substantially defining an outer boundary of the sidewalls structure, the exterior tube being proximate the exterior ends of the sidewalls.

31. The device of claim 30 further comprising an inlet tube and an outlet tube, each of the inlet tube and the outlet tube being coupled to the exterior tube, the inlet tube including openings formed therein and the exterior tube having openings formed therein proximate the inlet tube openings such that the inlet tube is in flow communication with the inlet passage, the outlet tube having openings including openings formed therein and the exterior tube having openings formed therein proximate the outlet tube openings such that the outlet tube is in flow communication with the outlet passage.

32. A device for thermally processing a gas stream, comprising:

a structure having at least two coiled sidewalls that are interspersed apart, wherein each of the coiled sidewalls has an interior end and two longitudinal ends;

at least two spiral passages formed between the two coiled sidewalls for passing the gas stream through the structure, wherein at least one of the spiral passages is an inlet for the gas stream and at least another of the spiral passages is an outlet for the gas stream;

means, located at the interior ends of the coiled sidewalls, for directing the gas stream in the at least one spiral inlet passage to the at least one spiral outlet passage, and a matrix of a first type of heat resistant porous inert media disposed in at least a portion of the at least one inlet spiral passage, and a matrix of a second type of heat resistant porous inert media disposed in at least a portion of the at least one outlet spiral passage.

33. The device of claim 32 wherein the means for directing the gas stream in the at least one spiral passage to the at least one spiral outlet passage is a chamber.

34. The device of claim 33 wherein the chamber comprises a matrix of heat resistant inert media which is of a different type than at least one of the first and second types.

35. A device for thermal processing of a gas stream, comprising:

a structure having at least two coiled sidewalls that are interspaced apart, wherein each of the coiled sidewalls has an interior end and upper and lower edges;

at least two spiral passages formed between the two coiled sidewalls for passing the gas stream through the structure, wherein at least one of the spiral passages is an inlet for the gas stream and at least another of the spiral passages is an outlet for the gas stream;

means, located at the interior ends of the coiled sidewalls, for directing the gas stream in the at least one spiral inlet passage to the at least one spiral outlet passage; and a matrix of heat resistant porous inert media disposed in at least a portion of the structure.

36. A flameless thermal oxidizer for oxidizing contaminants in a gas stream, comprising:

a structure having at least two coiled sidewalls that are interspaced apart, wherein each of the coiled sidewalls has an interior end and upper and lower edges;

at least two spiral passages formed between the two coiled sidewalls for passing the gas stream through the structure, wherein at least one of the spiral passages is an inlet for the gas stream and at least another of the spiral passages is an outlet for the gas stream;

means, located at the interior ends of the coiled sidewalls, for directing the gas stream in the at least one spiral inlet passage to the at least one spiral outlet passage; and a matrix of heat resistant porous inert media disposed in at least a portion of the structure, wherein the matrix transfers a substantial quantity of heat away from a reaction zone within the flameless thermal oxidizer such that the gas stream contaminants are oxidized flamelessly and with a lower level of NOx production as compared to oxidation using open flame combustion.

37. A device for thermally processing of a gas stream, comprising:

a structure having at least two coiled sidewalls that are interspaced apart, wherein each of the coiled sidewalls has an interior end and two longitudinal ends;

at least two spiral passages formed between the two coiled sidewalls for passing the gas stream through the structure, wherein at least one of the spiral passages is an inlet for the gas stream and at least another of the spiral passages is an outlet for the gas stream;

means, located at the interior ends of the coiled sidewalls, for directing the gas stream in the at least one spiral inlet passage to the at least one spiral outlet passage; and a matrix of heat resistant porous inert media disposed in at least a portion of the structure.

* * * * *